United States Patent [19]

Tapp et al.

[11] 4,282,728

[45] Aug. 11, 1981

[54] KNEE PROTECTIVE SOCK

[75] Inventors: Robert H. Tapp, Bronxville, N.Y.; Clarence W. Wall, Newton, N.C.

[73] Assignee: Rudin & Roth, Inc., New York, N.Y.

[21] Appl. No.: 889,501

[22] Filed: Mar. 23, 1978

[51] Int. Cl.[3] ..... D04B 9/46

[52] U.S. Cl. ..... 66/182; 2/239; 2/241

[58] Field of Search ..... 2/239, 241; 66/182, 66/178 R, 178 A

[56] References Cited

U.S. PATENT DOCUMENTS

| | | | |
|---|---|---|---|
| 210,810 | 12/1878 | Selby | 2/241 X |
| 372,170 | 10/1887 | Pepper | 66/182 |
| 445,352 | 1/1891 | Merrow et al. | 66/182 |
| 1,581,067 | 4/1926 | Kleindienst | 2/241 X |
| 1,919,487 | 7/1933 | Thompson | 66/182 |
| 2,108,540 | 2/1938 | Lochhead | 66/182 |
| 2,136,426 | 11/1938 | Folkman | 66/182 |
| 2,229,790 | 1/1941 | Beuter et al. | 66/182 |
| 2,338,075 | 12/1943 | Hemmerich | 66/182 |
| 3,342,044 | 9/1967 | Corey | 66/182 X |
| 3,828,585 | 8/1974 | Thorneburg | 66/182 X |

*Primary Examiner*—H. Hampton Hunter

*Attorney, Agent, or Firm*—Stephen E. Feldman; Marvin Feldman

[57] ABSTRACT

A knee protective sock is disclosed which is particularly designed and useful in skateboarding wherein the sock comprises distinct but integrally knitted foot and calf portion, below knee portion and knee portion. The below knee portion is of a tight strong weave so as to grip the leg, while the knee portion is of thicker, heavier knit than the other portions. All the portions are integrally knitted so as to provide in effect a single continuous one-piece sock. The sock combines the wear, comfort and protective characteristics necessary to a skateboarder readily subject to falling from the skateboard. Further the specific gripping portions of the sock prevent the sock from slipping during skateboard activity.

9 Claims, 3 Drawing Figures

KNEE PROTECTIVE SOCK

FIELD OF THE INVENTION

This invention relates to knee protective socks. Specifically this invention relates to a sock for skateboard useful activity.

BACKGROUND OF THE INVENTION

Heretofore it was known in the prior art to add padding and/or multiple layers of stocking material at the knee region to protect the knee when worn. Typical of such prior art construction were Selby, U.S. Pat. No. 210,810, granted Dec. 10, 1878; Berger U.S. Pat. No. 422,702, granted Mar. 4, 1890; Hurdel, U.S. Pat. No. 726,299, granted Apr. 28, 1903; Gailbraith, U.S. Pat. No. 927,785, granted July 13, 1909; Pierce, U.S. Pat. No. 1,225,354, granted May 8, 1917; and Chesebro, Jr., U.S. Pat. No. 3,994,322, granted Dec. 7, 1976.

Said prior art sock constructions were often bulky and uncomfortable in use; costly in both materials of construction and manufacturing; and often required multiple piece assembly and adjustment. Further the bulky and multiple material aspects made conventional laundering difficult. Still further, some of the prior art socks were so constructed as to fit only a specific size foot and leg.

Now there is provided by the present invention a sock which is specifically useful in skateboarding and which does not require the addition of padding or reinforcing members.

It is another aspect of this invention to provide a sock wherein the sock is prevented from slipping so that the comfort and protection afforded to the wearer remains during skateboarding.

It is another aspect of this invention to provide a sock which is of integral knitted construction and which is useful in skateboarding without the addition of padding or reinforcing members.

It is another aspect of this invention to provide a sock as aforesaid which is of one-piece woven construction.

It is still another aspect of this invention to provide a sock which is protective in the critical knee region and yet provides the comfort in the foot region.

It is still another aspect of this invention to provide a sock which is effectively a one-piece construction which does not require the addition or attachment of other pieces of padding or reinforcement.

It is a further aspect of this invention to provide a sock which is useful in several foot-leg sizes.

It is still a further aspect of this invention to provide a sock as aforesaid which is readily washable.

It is still another aspect of this invention to provide a sock which is readily fabricated of relatively inexpensive materials and yet safe and practical in skateboarding use.

The aforesaid as well as other objects and advantages as will become apparent from a reading of the following specification, the adjoined claims, and the accompanying drawings in which:

DESCRIPTION OF THE PREFERRED EMBODIMENTS

Figure 1:
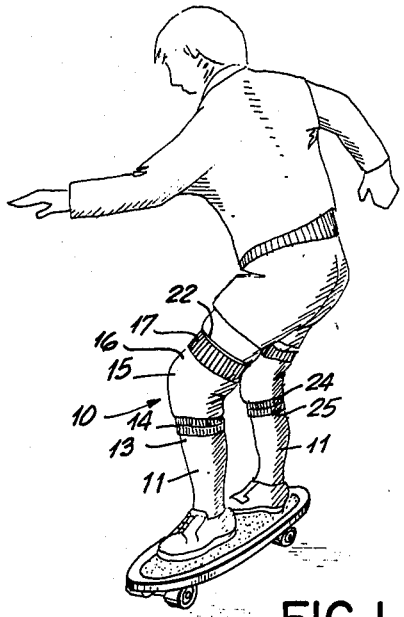
FIG. 1 is a perspective view of the sock of this invention as worn in use in skateboarding.
Figure 2:
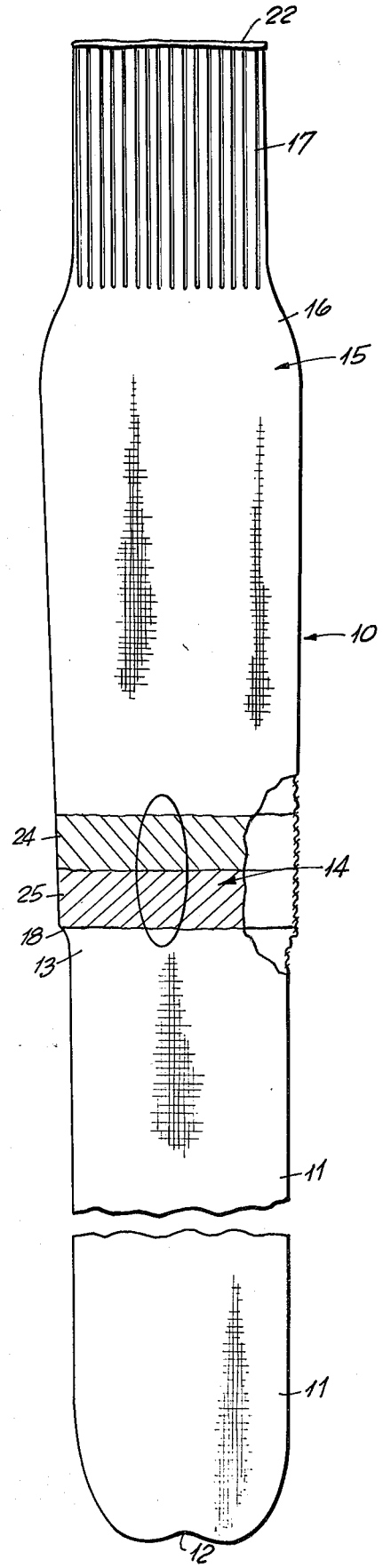
FIG. 2 is a plan view of the sock of this invention in the unworn condition, with a partial fragmentary section at the knee region.
Figure 3:
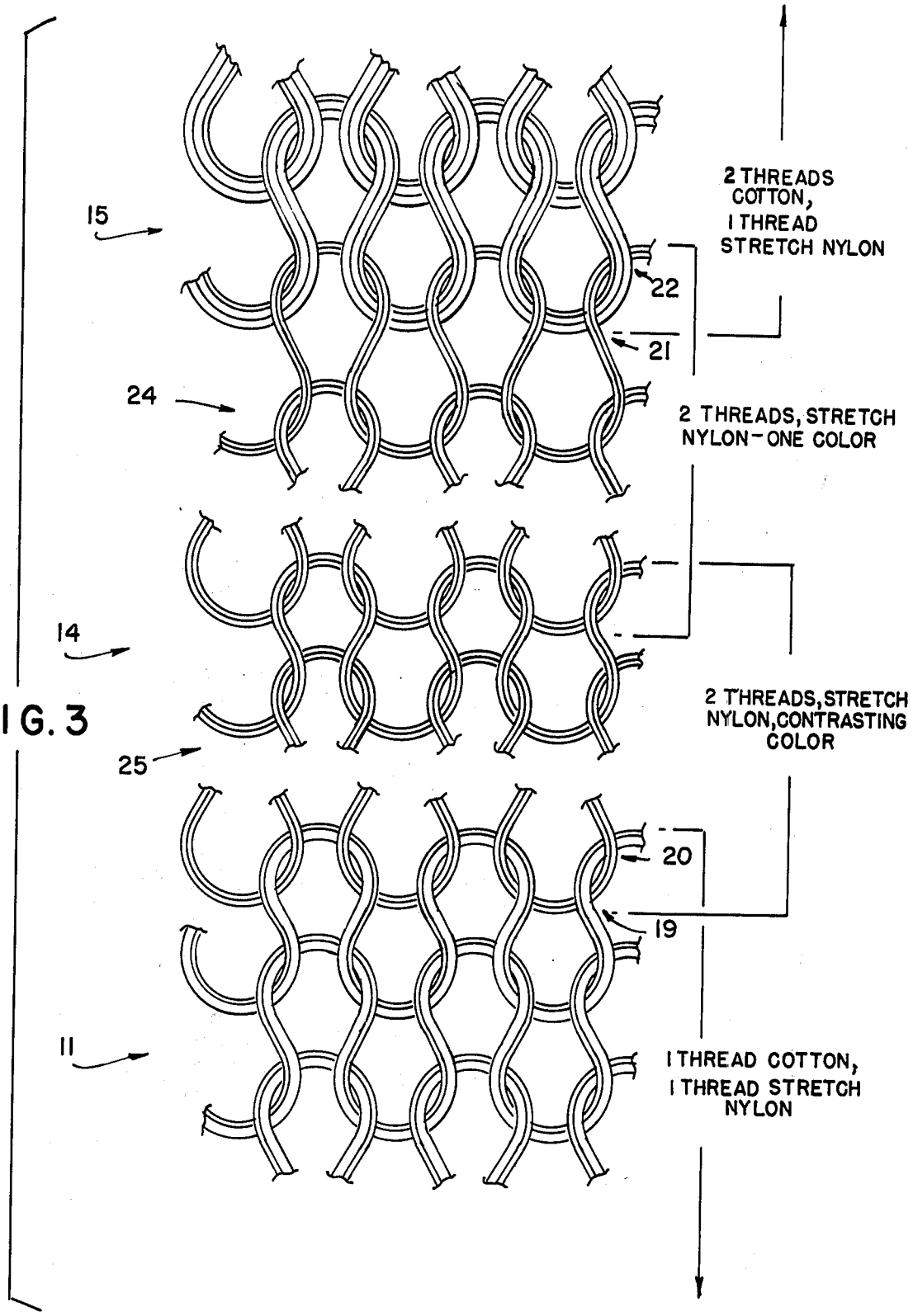
FIG. 3 is a greatly enlarged partial view of the knitted portion of the sock of FIG. 2.

Referring to the FIGS. 1–3, there is shown the skateboard sock of this invention, generally designated as 10. Sock 10 comprises a first portion or foot and calf portion 11 extending from the toe end 12 to some distance below the knee at 13; a second portion or just below the knee portion 14 is connected to first portion 11; and a third portion or knee portion 15 is connected to said second portion 14 and extends above the knee at 16. Third portion 15 also comprises an elastic webbing or cuff 17 which encircles the leg at the thigh, and in conjunction with the second portion prevents downward slippage of the sock. First portion 11 is of lesser width than second portion 14 and third portion 15, and extends upwardly and outwardly at 18 to meet and connect with the second portion 14.

The second portion 14 is of strong elastic and provides better gripping than first portion 11. This permits the wearer to have the desired comfort in wear but prevents the downward slipping of the sock so as to assure the protection and service at the critical knee region. The fabric of third portion 15 is thicker than first portion 11, because of the increased need for protection and padding in the critical knee region.

The portions 11, 14, 15 as well as 17 are integrally woven wherein the ribbing of each respective portion, 11, 14 and 15 is interknitted as at 19 to 20 and 21 to 22. In this manner of construction the ribbing of all the portions are in alignment despite the different elastic and wear properties of the respective portions. Elastic portion 14 and webbing or cuff 17 combine to prevent downward slipping of the sock during skateboarding. All portions of the sock, 11, 14, 15 and 17 are circumferential in nature and extend around the entire leg and foot.

It was surprisingly found that a large amount of yarn could be integrally knitted at the knee region. Specifically the yarn at the knee region comprises a double thickness of cotton in combination with a single thickness of stretch nylon. This three thread combination was knitted on a 108-needle circular knitting machine to form this third (knee) portion 15. It was further found that the first portion 11 could be knitted of a single cotton thread combined with a single nylon thread to give a tight, elastic, not comfortable wear character, while the second portion comprised at least two and possibly four threads (ie. two doubled threads) of stretch nylon so as to provide a tight gripping portion. It was further surprisingly found that the aforesaid three portions could be formed into an integral one-piece sock in a 108-needle circular knitting operation.

The top webbing 17 may be of conventional Morpule cuffing and comprise four threads or ends of nylon in combination with one thread or end of rubber.

It has been found that the aforesaid combination of commercial cotton thread and 100 denier nylon thread, as aforesaid, is most suitable to achieving the desired results of this invention. While other materials may conceivably be useful pursuant to the present invention, the cotton-and-nylon combinations as aforesaid have been found to achieve the desired results. Other useful materials may include the natural and synthetic fibers, and combinations thereof.

Another aspect of the present invention is wherein the several aforesaid portions with their distinctive stretch and wear characteristics may be proportioned such that only one size of sock is needed to fit most conventional boys sizes and only one size of sock is needed to fit most conventional mens sizes, as shown in the following Table I.

TABLE I

| Portion, Length (in.) | Boys | Mens |
|---|---|---|
| First | 14 | 17 |
| Second | $1\frac{5}{8}$ | $1\frac{5}{8}$ |
| Third* | $6\frac{1}{2}$ | 8 |
| Webbing cuff | 3 | $3\frac{1}{2}$ |
| Overall length (in.) | $25\frac{1}{8}$ | $30\frac{1}{8}$ |

*without top webbing cuff

In association with the determination of the proportions as aforesaid, it was found that the ratio of the length of the protective knee portion (ie. third portion without top webbing cuff) to the length of first portion is about 0.47 for all sizes of sock, both for boy's and men's socks. This recognition of proportion permits universal sizing of the sock without sacrificing the wear character and comfort of any one user.

This proportion in the lengths of the several portions, combined with the elastic character of the sock, permits the sock to be worn by persons of different size feet and legs, and yet still provide the required protection in the knee region during skateboarding.

It is thus apparent that the sock combines the wear and comfort of a commercially acceptable sock while providing the necessary protection in the knee region. This protection is important in skateboarding since the various maneuvers attempted on a skateboard often result in the skateboarding landing on his on the hard skateboarding surface. Often the skateboarder lands on the side of the knee as well as on the knee cap. The present construction is particularly suited in this respect insofar as the padding of the knee portion extends entirely around the knee region and not just in the front portion of the knee. In this maneuver, all sides of the knee are protected without sacrifice to the wear comfort of the user and more specifically without interfering in the maneuver ability of the skateboard competitor.

The skateboard sock of this present invention while comprising integrally knitted portions of separate wear and elastic character, may nevertheless by readily machine washed in conventional warm water washing.

As shown in FIGS. 1 and 2, the below knee region may be provided with a distinctive two-tone effect, as at 24 and 25, and one color 24 may be made so as to match the webbing 17 color.

In the drawings and specification, there has been set forth a preferred embodiment of the invention, and although specific terms employed, they are used in a generic and descriptive sense only and not for purposes of limitation.

Inasmuch as many changes would be made in the above construction, and many apparently different embodiments of the invention could be made without departing from the scope thereof, it is intended that all matter contained in the above description or shown in the accompanying drawing shall be interpreted as illustrative and not in a limiting sense.

What is claimed is:

1. A knee protective sock comprising a one-piece knit construction comprising a first portion for the foot and calf, a second portion for below the knee, and a third portion for the knee, said portions being integrally knitted, and wherein said third portion is of thicker knit than said other portions, and further comprising an elastic webbing attached to the third portion and forming the top of the sock, and wherein said first portion comprises a cotton thread and a stretch thread knit, said second portion comprising a two stretch thread knit, and said third portion comprising a three thread knit comprising two threads of cotton and one stretch thread, whereby the top elastic in combination with the said second portion grips the leg of the wearer to prevent slipping of all portions, and wherein the second portion is more elastic than the first and third portions so that said third portion is retained in position to protect the knee of the wearer.

2. The sock of claim 1, wherein the unworn condition, said first portion is of lesser width than said second and third portion.

3. The sock of claim 2, wherein the first portion extends outwardly to connect with the second portion.

4. The sock of claim 1, wherein the length of first portion is about 14 to 17 inches, the length of the second portion is about $1\frac{5}{8}$ inches, the length of the third portion with webbing is about $9\frac{1}{2}$ to $11\frac{1}{2}$ inches.

5. The sock of claim 1, wherein the ratio of the length of the third portion to the first portion is 0.47.

6. The sock of claim 1, wherein the third portion extends from just below the knee to above the knee.

7. The sock of claim 1, wherein each of said portions are circular knitted so as to provide an integral one-piece sock.

8. The knee protective sock comprising a one-piece knit construction comprising a first portion for the foot and calf, a second portion for below the knee, and a third portion for the knee, said portions being integrally knitted, and wherein said third portion is of thicker knit than said other portions, and said third portion further comprising an elastic webbing and forming the top of the sock, and wherein said first portion and second portions comprise a two-thread knit comprising cotton thread and stretch thread and said third portion comprising a three-thread knit comprising cotton and stretch threads, whereby the third portion in combination with the said elastic portion and second portion grip the leg of the wearer to prevent slipping of all portions so that said third portion is retained in position to protect the knee of the wearer.

9. The sock of claim 8, wherein said stretch threads comprise nylon.

* * * * *